US006891514B1

(12) United States Patent
Henry et al.

(10) Patent No.: US 6,891,514 B1
(45) Date of Patent: May 10, 2005

(54) LOW OBSERVABLE MULTI-BAND ANTENNA SYSTEM

(75) Inventors: Willard Henry, San Diego, CA (US); Thinh Q. Ho, Anaheim, CA (US); Kevin Allen, San Diego, CA (US); Charles Hewett, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 131 days.

(21) Appl. No.: 10/392,489

(22) Filed: Mar. 18, 2003

(51) Int. Cl.[7] ..... H01Q 21/00
(52) U.S. Cl. ..... 343/893
(58) Field of Search ..... 343/755, 700 MS, 343/756, 893, 907, 911 R, 914, 915

(56) References Cited

U.S. PATENT DOCUMENTS 5,917,458 A 6/1999 Ho et al.
6,184,832 B1 2/2001 Geyh et al.
6,239,762 B1 5/2001 Lier
6,326,920 B1 12/2001 Barnett et al.
6,473,057 B2 10/2002 Monzon
6,492,943 B1 12/2002 Marumoto et al.
6,512,934 B2 1/2003 Ihara et al.
6,642,889 B1 * 11/2003 McGrath ..... 343/700 MS
6,642,908 B2 * 11/2003 Pleva et al. ..... 343/876
6,653,985 B2 * 11/2003 Sikina et al. ..... 343/853
2003/0132890 A1 * 7/2003 Rawnick et al. ..... 343/824

* cited by examiner

*Primary Examiner*—Don Wong
*Assistant Examiner*—Minh Dieu A
(74) *Attorney, Agent, or Firm*—Michael A. Kagan; Allan Y. Lee; Peter A. Lipovsky

(57) ABSTRACT

An antenna system includes: a) a ground plane; b) an array of antennas affixed to the ground plane, wherein each antenna element includes a stack of antenna elements; c) a dielectric spacer affixed to the array of antennas, and e) a frequency selective surface affixed to the dielectric spacer. Each antenna element includes a radio frequency element affixed to a dielectric layer.

13 Claims, 4 Drawing Sheets

LOW OBSERVABLE MULTI-BAND ANTENNA SYSTEM

BACKGROUND OF THE INVENTION

Shipboard communications systems generally require multiple bandwidth radio frequency (RF) performance. Multiple antennas are typically employed to achieve such performance, where each antenna is designed for a particular portion of the RF spectrum. One disadvantage of multiple antennas is that they typically provide significant radar signatures. Thus, a need exists for a multi-band antenna system that provides broad bandwidth performance having a desired gain or directivity in the different bands, but with a diminished radar signature.

BRIEF DESCRIPTION OF THE DRAWINGS

Throughout the several views, like elements are referenced using like references.

SUMMARY OF THE INVENTION

An antenna system includes: a) a ground plane; b) an array of antennas affixed to the ground plane, wherein each antenna includes a stack of antenna elements; c) a dielectric spacer affixed to the array of antennas; and e) a frequency selective surface affixed to the dielectric spacer. Each antenna element includes a radio frequency element affixed to a dielectric layer.

DESCRIPTION OF THE PREFERRED EMBODIMENT

Figure 1:
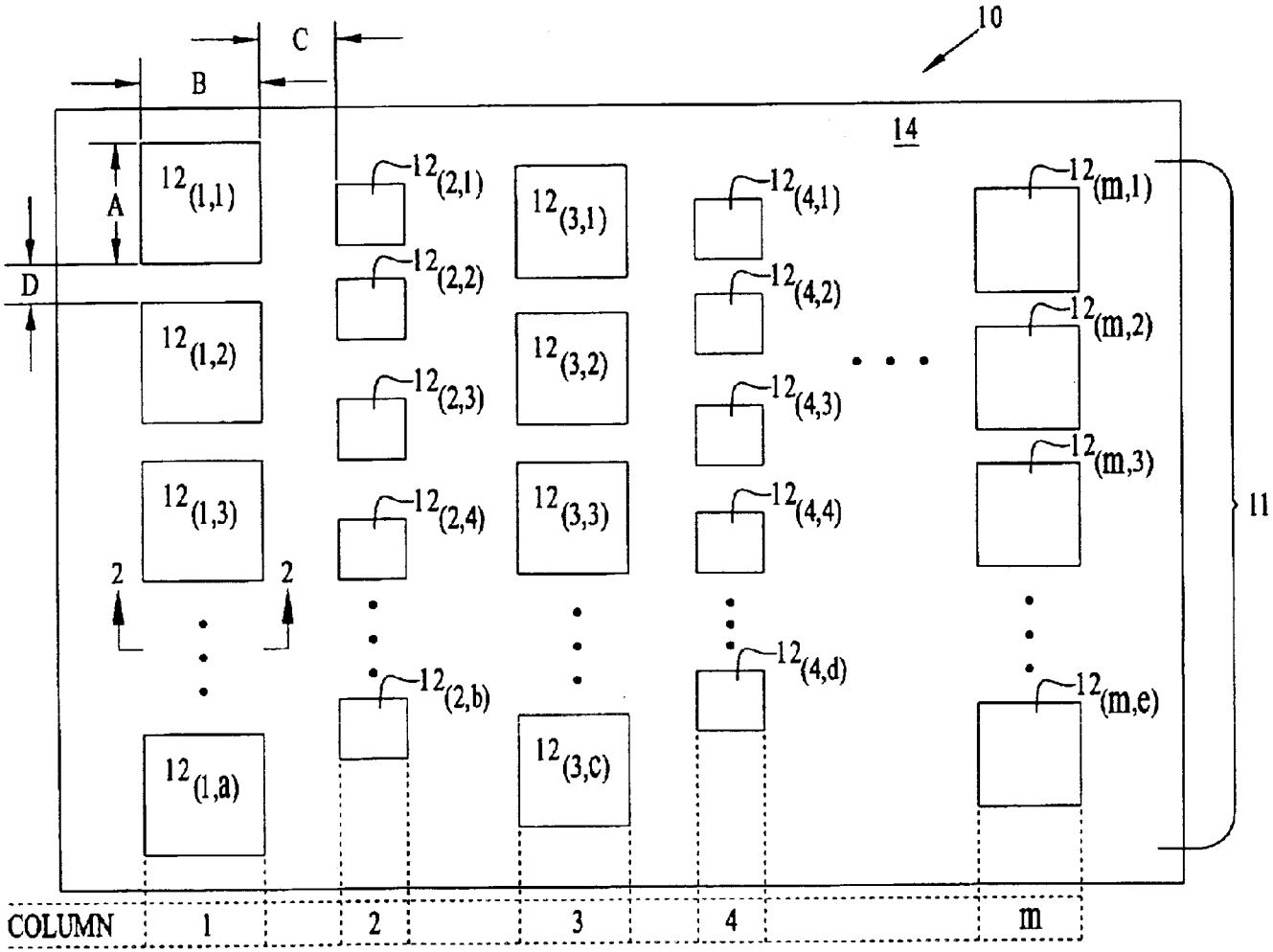
FIG. 1 shows a plan view of an embodiment of a multi-band antenna system.
Figure 2:
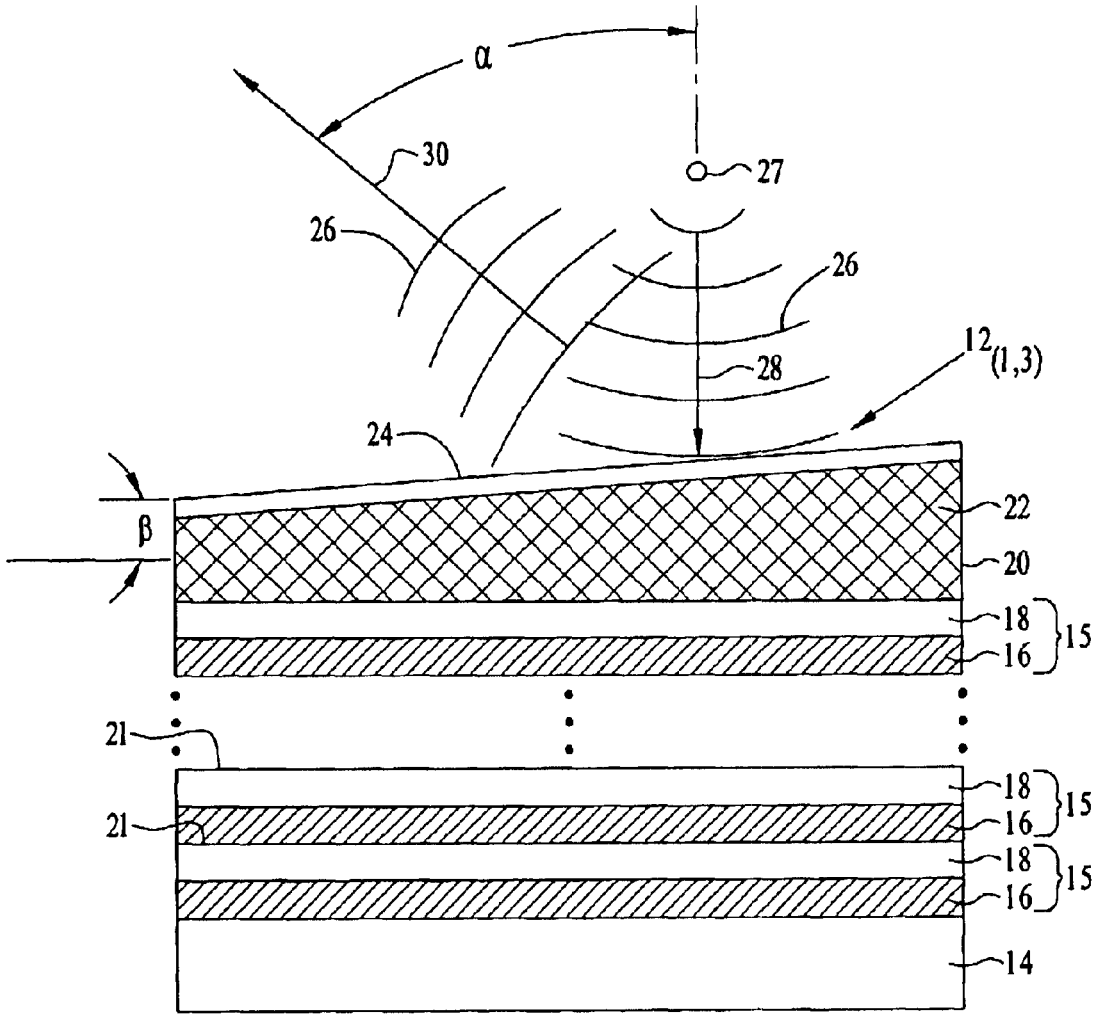
FIG. 2 shows a cross-sectional view of section 2—2 of the antenna system of FIG. 1.

Referring to FIGS. 1 and 2, there is shown a multi-band antenna system 10 that includes an array 11 of antennas $\mathbf{12}_{(i,j)}$ that are affixed to a ground plane 14 and arranged in m columns, where i and j represent positive integer indexes, and m represents the number of columns in array 11. In particular, i represents one of the m columns, and j represents a specific antenna element in one of the m columns, where $1 \leqq j \leqq m$. The number of antennas 12(*i,j*) in each column may or may not be the same as the number of antennas in any other column, depending on the requirements of a particular application. The number of antennas in each column determines the gain or directivity of the antennas for a particular bandwidth, and is based on the requirements of a particular application. For example, in FIG. 1, column 1 (antennas $\mathbf{12}_{(i,j)}$) may include an a number of antennas, column 2 may include a b number of antennas, column 3 may include a c number of antennas, column 4 may include a d number of antennas, and column m may include an e number of antennas. Although FIG. 1 shows five columns of antennas $\mathbf{12}_{(i,j)}$, it is to be understood that embodiments of antenna system 10 may include one or more integral number of columns of antennas. In one embodiment, each of antennas $\mathbf{12}_{(i,j)}$ in a particular $m^{th}$ column may have a generally rectangular radiating area defined by A×B, where $$A \leq \left(\frac{\lambda}{2}\right),$$

and $$B \leq \left(\frac{\lambda}{2}\right),$$

where λ represents the center wavelength of a radio frequency band that is detectable by a particular $m^{th}$ column of antennas $\mathbf{12}_{(i,j)}$. The distance C between adjacent antennas in separate columns may be given by:

$$C = \frac{\lambda_1 + \lambda_2}{2},$$

where $\lambda_1$ represents the design center wavelength of the antennas in one column and $\lambda_2$ represents the design center wavelength of the antennas in an adjacent column. The distance D between antenna element in a particular column may be established so as to meet the requirements of a particular application. Although in FIG. 1, antennas $\mathbf{12}_{(i,j)}$ are shown to have rectangularly shaped radiating areas, multi-band antenna system 10 may also be implemented wherein the radiating areas of antennas $\mathbf{12}_{(i,j)}$ have shapes other than rectangles. For example, antennas $\mathbf{12}_{(i,j)}$ may also have radiating areas configured in shapes that include circles, triangles, loops, ellipses, rectangular spirals, circular spirals, and other shapes that may be required to suit the requirements of a particular application.

The number of j antennas $\mathbf{12}_{(i,j)}$ in a particular $m^{th}$ column collectively define a sub-antenna system having a unique combined effective radiating area $AR_m$, and hence determine the gain or directivity of that particular group of antennas for receiving radio frequency energy characterized by a $\lambda_m$ center wavelength. Each of the antennas $\mathbf{12}_{(a,j)}$ in a particular $i^{th}$ column have a radiating area that is unique to that column. Thus, the antennas in each column collectively have a unique combined effective radiating area that is determined by the number of antennas associated with each frequency band. The antennas $\mathbf{12}_{(i,j)}$ may be configured in alternating arrays of antennas designed to detect relatively lower and higher RF bands, wherein each band may include one or more columns of antennas $\mathbf{12}_{(i,j)}$. Appropriate spacing between adjacent arrays of antennas $\mathbf{12}_{(i,j)}$ prevents cross-talk between antenna arrays designed for detecting RF energy having different, but in some cases, closely spaced center wavelengths.

Figure 4:
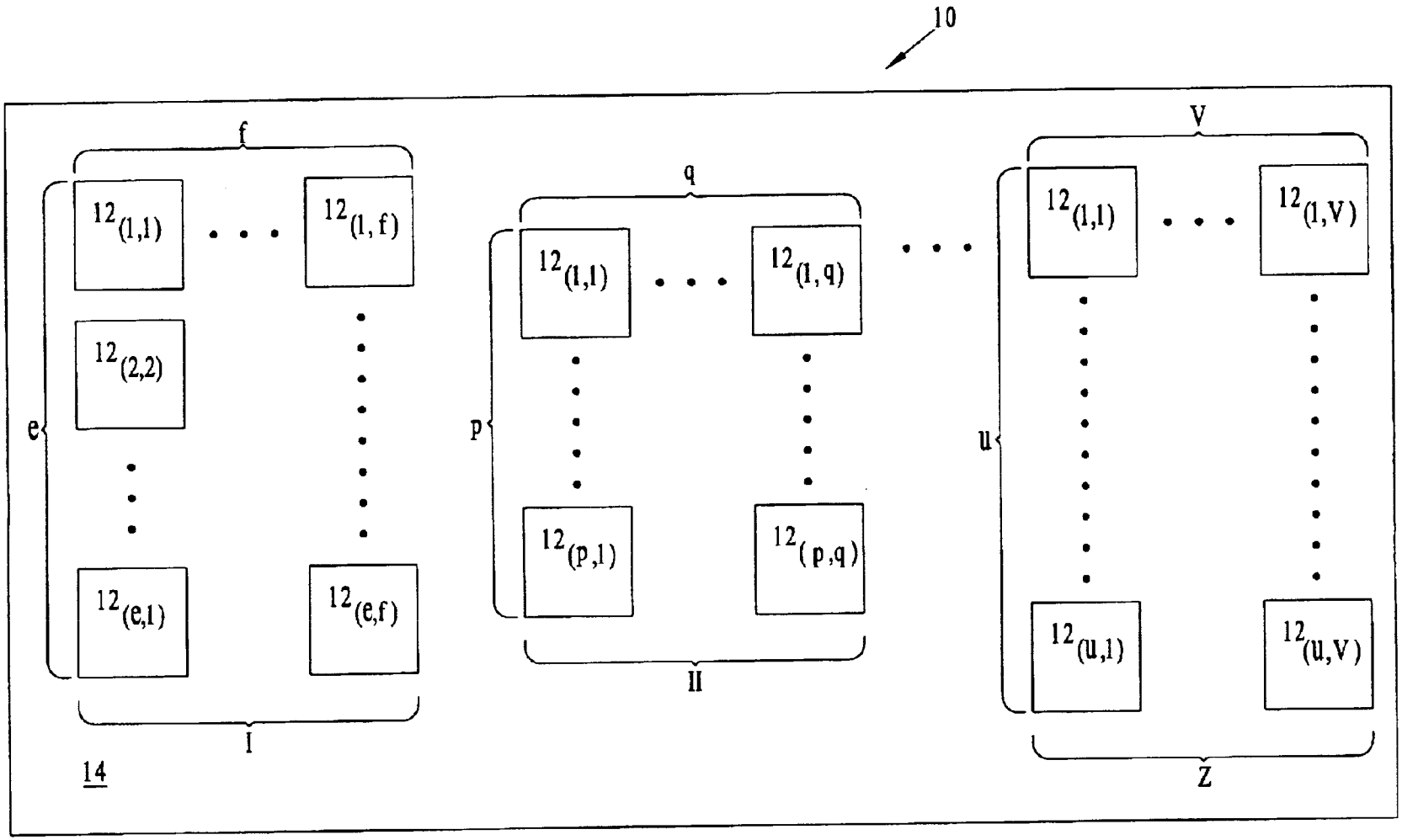
FIG. 4 show a plan view of another embodiment of a multi-band antenna system.

Referring now to FIG. 4, there is shown another embodiment of multi-band antenna system 10 which includes multiple arrays of antennas that are grouped into I through Z arrays of antennas $\mathbf{12}_{(i,j)}$, where each set of antennas is designed to detect RF energy having a particular center wavelength λ that may be unique to the antennas of each array, where Z is a positive integer, and $Z \geqq 1$. For example, as shown in FIG. 4, array I includes an e×f array of antennas, where e represents the number of rows and f represents the number of columns of the array I, array II includes an p×q array of antennas, where p represents the number of rows and q represents the number of columns of the array II; array Z includes a u×v array of antennas, where u represents the number of rows and v represents the number of columns of the array Z; and e, f, p, q, u, and v are positive integers.

Antennas $\mathbf{12}_{(1,3)}$ are described herein and depicted in FIG. 2 to illustrate an embodiment of the antenna system 10.

However, it is to be understood that FIG. 2 is representative of every antenna $\mathbf{12}_{(i,j)}$. Antenna $\mathbf{12}_{(1,3)}$ is affixed to ground plane 14 which may consist essentially of a layer of copper having a thickness in the range of about 1 to 1000 mils. A stack of antenna elements 15 are affixed together and mounted to ground plane 14. Each antenna element 15 includes a dielectric layer 16 on which a radio frequency element 18 is affixed, as for example, by bonding. A radio frequency element is a patch of conductive material for detecting radio frequency energy. By way of example, radio frequency elements 18 may consist essentially of copper having thickness in the range of about 0.5 to 3 mils. Dielectric layer 16 may be fabricated from materials that include foam, FR4®, (circuit board) e-glass, s-glass, or any other suitable dielectric material that is capable of being bonded or formed to the material that comprises radio frequency elements 18, and may have a thickness in the range of about 3 mils to 0.1 inch. Thus, it may be appreciated that antenna element $\mathbf{12}_{(1,3)}$ may be comprised of one or more antenna elements 15 that define an alternating series of dielectric layers 16 and radio frequency elements 18. Antenna element $\mathbf{12}_{(1,3)}$ further includes a dielectric spacer 20 that is affixed to the radio frequency element 18 comprising the antenna element 15 furthest from ground plane 14. A frequency selective surface (hereinafter also referenced as "FSS") structure 22 having a frequency selective surface 24 is affixed to dielectric spacer 20, and is configured to be transparent to RF energy characterized by wavelengths having center frequencies of $\lambda_1, \lambda_2 \lambda_3 \ldots$ and $\lambda_m$, but which reflects other RF energy. The scope of the invention also includes the case where an antenna may be comprised of only one antenna element 15. In another embodiment, the number of antenna elements 15 of the antennas $\mathbf{12}_{(i,j)}$ may be different in each array.

In one embodiment of antenna system 10, shown in FIG. 2, RF energy 26 that is not intended to be detected by antenna system 10 may be traveling from a locus 27 in the direction of arrow 28, but may be reflected by frequency selective surface 24 of frequency selective surface structure 22 at a non-zero angle $\alpha$ in the direction of arrow 30 with respect to the direction of arrow 28 so that RF energy 26 does not substantially return to locus 27. The orientation of the frequency selective surface 24 of frequency selective surface structure 22 may be at a non-zero angle $\beta$ with respect to the surface 21 of the radio frequency elements 21. Such orientation assures that RF energy 26 is virtually undetectable at locus 27, thereby providing antenna element $\mathbf{12}_{(1,3)}$, and antenna system 10 with a reduced radar signature. Examples of frequency selective surfaces having various aperture configurations suitable for use in conjunction with antenna system 10 are taught in commonly assigned U.S. Pat. No. 5,917,458.

Figure 3:
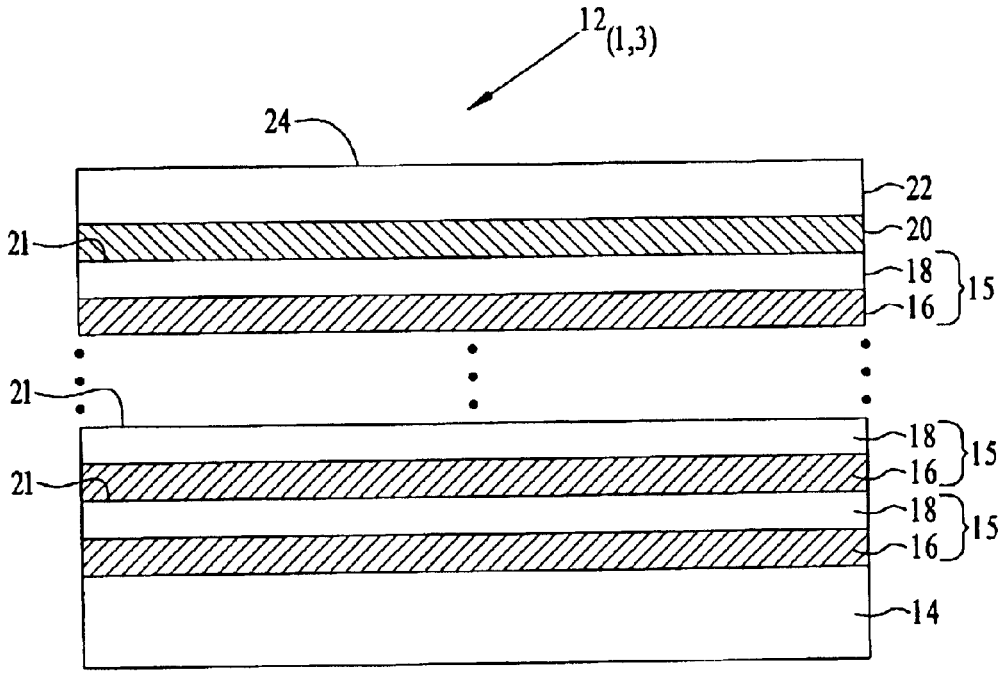
FIG. 3 shows a cross-sectional view of another embodiment of a specific antenna of a multi-band antenna system.

In another embodiment of antenna system 10, shown in FIG. 3, frequency selective surface structure 22 may have a frequency selective surface 24 that is generally parallel to the surfaces 21 of radio frequency elements 18.

Obviously, many modifications and variations of the antenna system described herein are possible in light of the above teachings. It is therefore to be understood that within the scope of the appended claims, multi-band antenna system 10 may be practiced otherwise than as specifically described.

We claim:

1. An antenna system, comprising:

a ground plane;

an array of antennas affixed to said ground plane, wherein each of said antennas includes a stack of antenna elements, and each said antenna element includes a radio frequency element affixed to a dielectric layer, and wherein said array of antennas comprises a plurality of sub-antenna systems, and wherein each of said plurality of sub-antenna systems has a combined effective radiating area for receiving RF energy associated with wavelengths having center wavelengths corresponding to center wavelengths of said antennas;

a dielectric spacer affixed to said array of antennas; and a frequency selective structure affixed to said dielectric spacer and having a frequency selective surface, wherein said frequency selective surface is configured to reflect RF energy other than RF energy associated with wavelengths having center wavelengths corresponding to center wavelengths of said antennas.

2. The antenna system of claim 1 wherein said antennas are arranged in columns, wherein each of said antennas in a particular one of said columns has a radiating area that is unique to said one column, and said antennas in said one column collectively have a unique combined effective radiating area.

3. The antenna system of claim 2 wherein said antennas in each of said columns are collectively disposed for detecting radio frequency energy having a unique center wavelength.

4. An antenna system, comprising:

a ground plane;

an array of antennas affixed to said ground plane, wherein each of said antennas has a radiating area and includes a stack of antenna element layers, and each said antenna element includes a radio frequency element affixed to a dielectric layer, and wherein said array of antennas comprises a plurality of sub-antenna systems, and wherein each of said plurality of sub-antenna systems has a combined effective radiating area for receiving RF energy associated with wavelengths having center wavelengths corresponding to center wavelengths of said antennas;

a dielectric spacer affixed to said array of antennas; and a frequency selective structure affixed to said dielectric spacer, wherein said frequency selective structure includes a frequency selective surface oriented at a non-zero angle with respect to said radiating area of each of said antennas, wherein said frequency selective surface is configured to reflect RF energy other than RF energy associated with wavelengths having center wavelengths corresponding to center wavelengths of said antennas.

5. The antenna system of claim 4 wherein said antennas are arranged in columns, said radiating areas of said antennas in each of said columns are unique, and said antennas in each column collectively have a unique combined effective radiating area.

6. The antenna system of claim 5 wherein said antennas in each said column are disposed for detecting radio frequency energy having a unique center wavelength.

7. An antenna system, comprising:

a ground plane;

an array of antennas affixed to said ground plane, wherein each of said antennas includes one or more antenna elements, and each said antenna element includes a radio frequency element affixed to a dielectric layer, and wherein said array of antennas comprises a plurality of sub-antenna systems, and wherein each of said plurality of sub-antenna systems has a combined effective radiating area for receiving RF energy associated with wavelengths having center wavelengths corresponding to center wavelengths of said antennas;

a dielectric spacer affixed to said array of antennas; and a frequency selective structure affixed to said dielectric spacer and having a frequency selective surface, wherein said frequency selective surface is configured to reflect RF energy other than RF energy associated with wavelengths having center wavelengths corresponding to center wavelengths of said antennas.

8. The antenna system of claim 7 wherein said antennas are arranged in columns, wherein each of said antennas in a particular one of said columns has a radiating area that is unique to said one column, and said antennas in said one column collectively have a unique combined effective radiating area.

9. The antenna system of claim 8 wherein said antennas in each of said columns are collectively disposed for detecting radio frequency energy having a unique center wavelength.

10. An antenna system, comprising:

a ground plane;

an array of antennas affixed to said ground plane, wherein each of said antennas has a radiating area and includes one or more antenna elements, and each said antenna element includes a radio frequency element affixed to a dielectric layer, and wherein said array of antennas comprises a plurality of sub-antenna systems, and wherein each of said plurality of sub-antenna systems has a combined effective radiating area for receiving RF energy associated with wavelengths having center wavelengths corresponding to center wavelengths of said antennas;

a dielectric spacer affixed to said array of antennas; and a frequency selective structure affixed to said dielectric spacer, wherein said frequency selective structure includes a frequency selective surface oriented at a non-zero angle with respect to said radiating area of each of said antennas, wherein said frequency selective surface is configured to reflect RF energy other than RF energy associated with wavelengths having center wavelengths corresponding to center wavelengths of said antennas.

11. The antenna system of claim 10 wherein said antennas are arranged in columns, said radiating areas of said antennas in each of said columns are unique, and said antennas in each column collectively have a unique combined effective radiating area.

12. The antenna system of claim 11 wherein said antennas in each said column are disposed for detecting radio frequency energy having a unique center wavelength.

13. An antenna system, comprising:

a ground plane;

arrays of antennas affixed to said ground plane, wherein each of said antennas includes a stack of antenna elements, each said antenna element includes a radio frequency element affixed to a dielectric layer, and each said array is disposed for detecting radio frequency energy having a unique center wavelength, and wherein each array of said arrays of antennas comprises a plurality of sub-antenna systems, and wherein each of said plurality of sub-antenna systems has a combined effective radiating area for receiving RF energy associated with wavelengths having center wavelengths corresponding to center wavelengths of said antennas;

a dielectric spacer affixed to said array of antennas; and a frequency selective structure affixed to said dielectric spacer and having a frequency selective surface, wherein said frequency selective surface is configured to reflect RF energy other than RF energy associated with wavelengths having center wavelengths corresponding to center wavelengths of said antennas.

* * * * *